US008405377B2

(12) United States Patent
Yu et al.

(10) Patent No.: US 8,405,377 B2
(45) Date of Patent: Mar. 26, 2013

(54) PROGRAMMABLE CURRENT MIRROR

(75) Inventors: Po-Shing Yu, Houlong (TW); Chia-Hsiang Chan, Pingzhen (TW)

(73) Assignees: Taiwan Semiconductor Manufacturing Co., Ltd., Hsin-Chu (TW); Global Unichip Corporation, Hsin-Chu (TW)

( * ) Notice: Subject to any disclaimer, the term of this patent is extended or adjusted under 35 U.S.C. 154(b) by 761 days.

(21) Appl. No.: 12/577,396

(22) Filed: Oct. 12, 2009

(65) Prior Publication Data

US 2011/0084682 A1 Apr. 14, 2011

(51) Int. Cl.
*G05F 3/16* (2006.01)
*G05F 3/20* (2006.01)

(52) U.S. Cl. ..... 323/315; 323/317

(58) Field of Classification Search ..... 323/312, 323/315, 317

See application file for complete search history.

(56) References Cited

U.S. PATENT DOCUMENTS

| | | | | |
|---|---|---|---|---|
| 4,608,530 | A | 8/1986 | Bacrania | |
| 6,462,527 | B1 | 10/2002 | Maneatis | |
| 6,710,665 | B2 | 3/2004 | Maneatis | |
| 7,119,527 | B2 * | 10/2006 | Fernald | 323/315 |

* cited by examiner

*Primary Examiner* — Harry Behm
*Assistant Examiner* — Matthew Grubb
(74) *Attorney, Agent, or Firm* — Duane Morris LLP

(57) ABSTRACT

A programmable current mirror a reference transistor, first and second mirror transistors, and a first current bypass. The reference transistor has a source and a gate coupled to a reference current node. The first and second mirror transistors are coupled together in series at a first node. Each of the first and second mirror transistors having gates coupled to each other and to the gate of the reference transistor. The first current bypass including a switch disposed in parallel with the second mirror transistor. The first current bypass is coupled to a source and a drain of the second mirror transistor and to the first node.

20 Claims, 6 Drawing Sheets

PROGRAMMABLE CURRENT MIRROR

FIELD OF DISCLOSURE

The disclosed system and method relate to integrated circuits. More specifically, the disclosed system and method relate to integrated circuits including programmable current mirrors.

BACKGROUND

Current mirrors are widely used in analog circuit design. Simple current mirrors produce an output current ($I_O$) that is related by a ratio to a reference current ($I_R$). The reference current is received by a reference transistor having an associated width-to-length ratio ($\alpha_R$). The gate of the reference transistor is connected to the gate of a mirror transistor having a gate width-to-length ratio ($\alpha_R$). The magnitude of the reference current $I_R$ determines the gate voltage arising at the reference transistor, which is passed to the gate of the mirror transistor. The gate voltage of the mirror transistor determines the magnitude of the output current $I_O$ drawn by the mirror transistor.

U.S. Pat. No. 6,462,527 issued to Maneatis discloses one example of a conventional programmable current mirror and includes a reference system 48 having a plurality of transistors 50, 52, 54, 56 coupled in parallel, and a mirror system 49 having a plurality of transistors 58, 60, 62 coupled in parallel as illustrated in FIG. 1. Each of the transistors of the reference system 48 and mirror system 49 has a switch coupled to its source. These current mirrors require different transistor biasing conditions for different control settings resulting in poor performance of the current mirror 49. For example, the biasing voltage at node 100, $V_{GS}$ of transistor 56, for various digital control words are as follows:

| Digital Control Word | $V_{GS}$ of Transistor 56 |
|---|---|
| 000 | $V_{GS} = \frac{2I_R}{k \cdot \alpha_R} + V_{th}$ |
| 001 | $V_{GS} = \frac{2I_R}{k \cdot 2\alpha_R} + V_{th}$ |
| 010 | $V_{GS} = \frac{2I_R}{k \cdot 3\alpha_R} + V_{th}$ |

Where, $k = \mu C_{OX}$;

$C_{OX}$ is the capacitance of the oxide layer of transistor 56;

$V_{th}$ is the turn-on voltage of transistor 56; and $\mu$ is the charge carrier effective mobility constant of transistor 56.

Thus, if the transistor size in the reference system is changed, the biasing voltage will need to be changed.

Accordingly, an improved programmable current mirror is desirable.

SUMMARY

In some embodiments, a programmable current mirror includes a reference transistor, first and second mirror transistors, and a first current bypass. The reference transistor has a source and a gate coupled to a reference current node. The first and second mirror transistors are coupled together in series at a first node. Each of the first and second mirror transistors have gates coupled to each other and to the gate of the reference transistor. The first current bypass includes a switch disposed in parallel with the second mirror transistor. The first current bypass is coupled to a source and a drain of the second mirror transistor and to the first node.

In some embodiments, a programmable current mirror includes a first reference transistor, first, second, third, and fourth mirror transistors coupled in series, and first, second, and third current bypasses coupled in parallel with the second, third, and fourth mirror transistors. The first reference transistor has a source and a gate coupled to a first node for receiving a reference current. The first and second mirror transistors are coupled together at a second node. The second and third mirror transistors are coupled together at a third node. The third and fourth transistors are coupled together at a fourth node. Each of the mirror transistors has a gate coupled together and to the gate of the first reference transistor. Each of the current bypasses includes a switch. The first current bypass is coupled to the second and third nodes in parallel with the second mirror transistor. The second current bypass is coupled to the third and fourth nodes in parallel with the third mirror transistor. The third current bypass is coupled to a source and a drain of the fourth mirror transistor and to the fourth node.

In some embodiments, a programmable current mirror includes a plurality of reference transistors coupled in series and a plurality of mirror transistors coupled in series. Each of the reference transistors has a gate coupled to the gates of the other reference transistors and to a first reference current node. Each of the mirror transistors has a gate coupled to the gates of the other mirror transistors and to the gates of each of the plurality of reference transistor. A respective current bypass is coupled in parallel with each of the reference and mirror transistors. Each of the current bypasses includes a switch.

DETAILED DESCRIPTION

Figure 1:
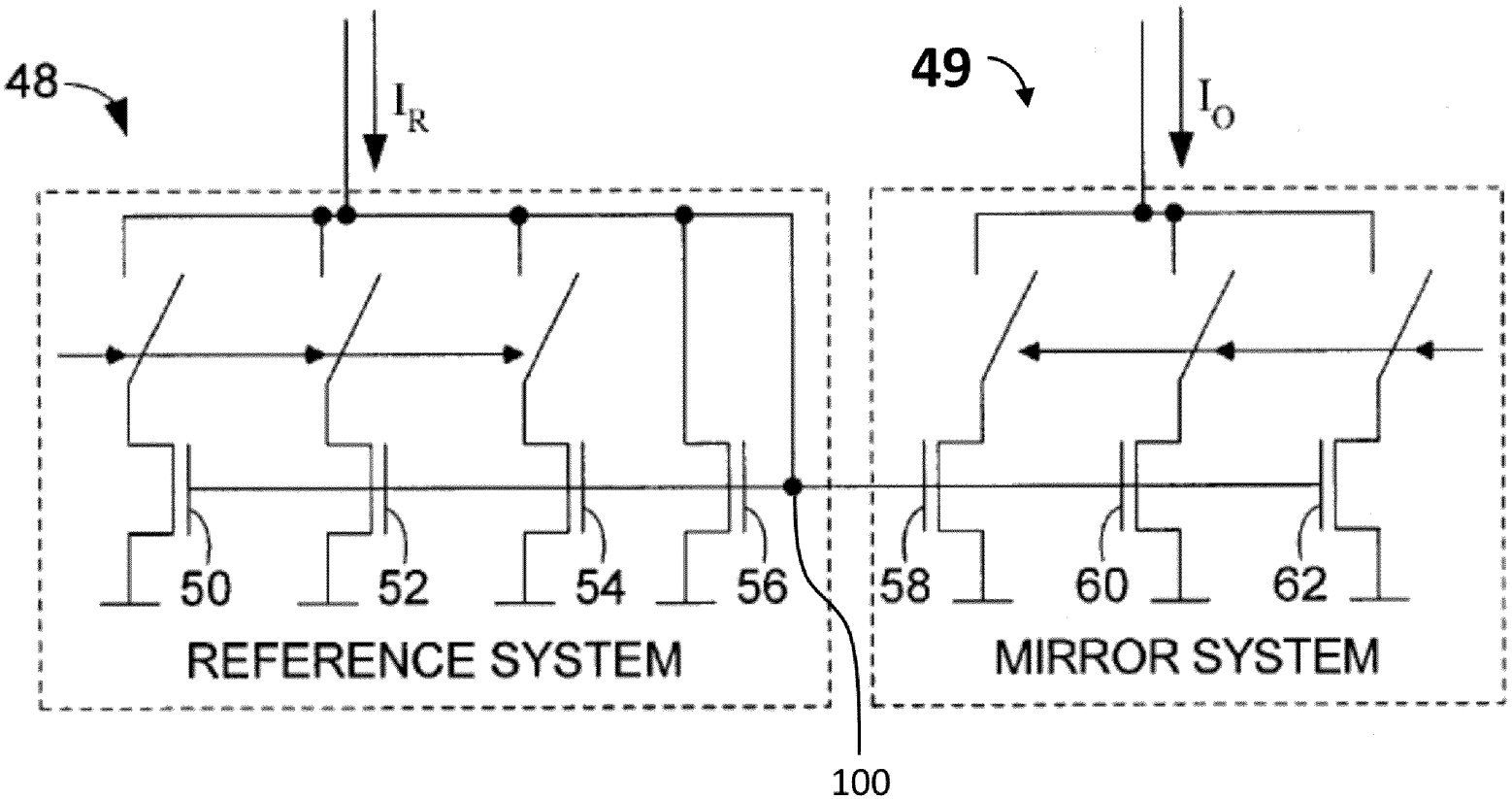
FIG. 1 (PRIOR ART)
FIG. 1 illustrates a conventional programmable current mirror.
Figure 2B:
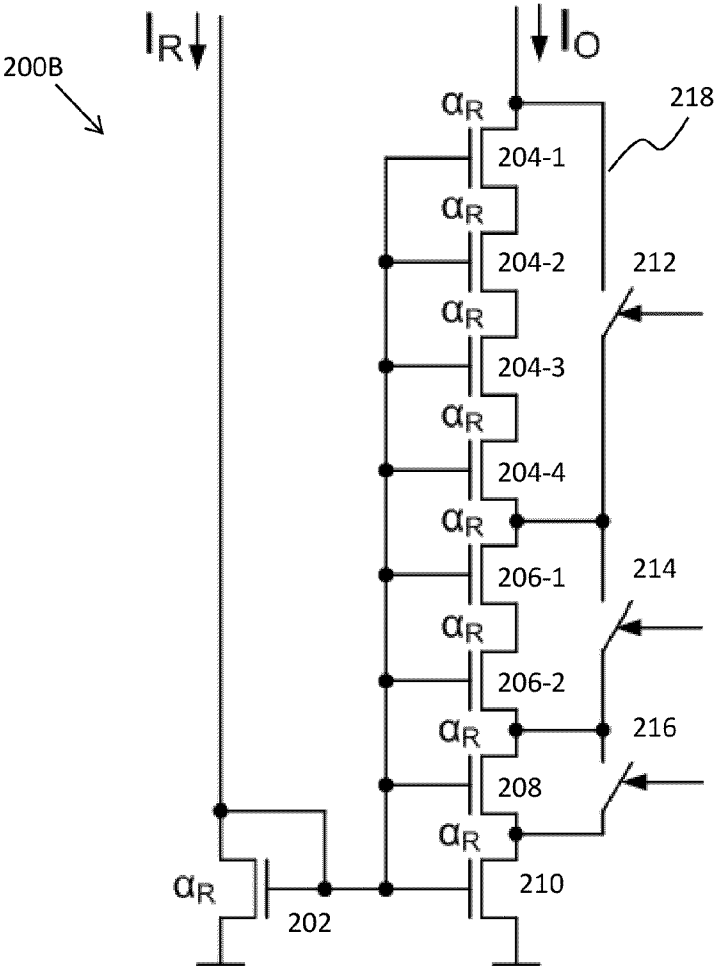
FIG. 2B illustrates an equivalent current mirror layout to the current mirror illustrated in FIG. 2A.
Figure 2A:
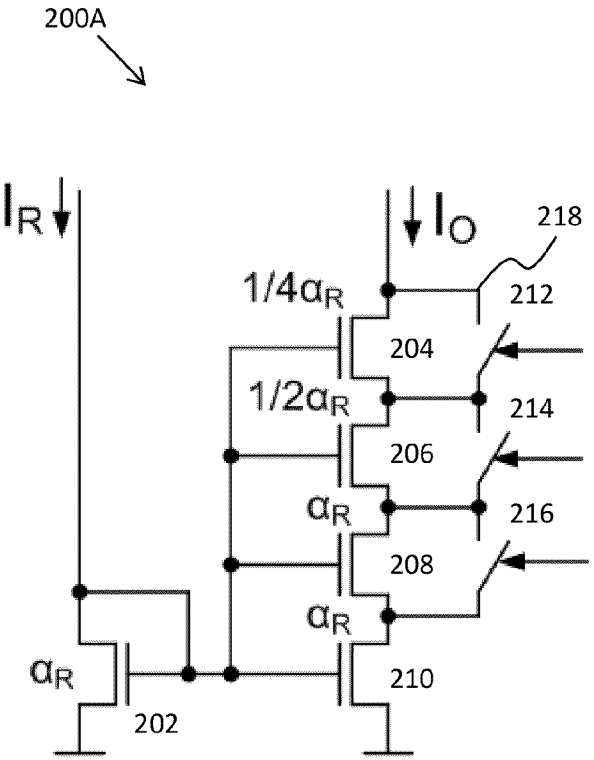
FIG. 2A illustrates one example of an improved inverse programmable current mirror.

FIG. 2A illustrates one example of an improved rational (non-integral) inverse programmable current mirror 200A. As shown in FIG. 2A, the programmable current mirror 200A includes a reference transistor 202 receiving a reference current $I_R$ at its source. The reference transistor 202 has its gate coupled to its source and to the gates of mirror transistors 204, 206, 208, and 210. Mirror transistors 204, 206, 208, and 210 are disposed in a linear array and are coupled to each other in a gate-to-gate cascode. Each of transistors 202, 208, and 210 have substantially equal gate width-to-length ratios, $\alpha_R$, (i.e., within processing tolerances of each other) and transistors 204 and 208 have gate width-to-length ratios that are respectively one-quarter and one-half of the gate width-to-length ratios of transistors 202, 208, and 210. A current bypass 218 is coupled in parallel with each of the transistors 204, 206, and 208 as well as being coupled to a respective source and drain of each of the transistors 204, 206, 208. Each of the current bypasses 218 includes a switch 212, 214, and 216. Switch 212 is coupled in parallel with transistor 204, switch 214 is coupled in parallel with transistor 206, and switch 216 is coupled in parallel with transistor 208.

FIG. 2B illustrates another example of a programmable current mirror 200B. Current mirror 200B is equivalent to the current mirror 200A illustrated in FIG. 2A as current mirror 200B is implemented with transistors all having the same gate width-to-length ratios, $\alpha_R$. As illustrated in FIG. 2B, transistors 204-1, 204-2, 204-3, and 204-4 (collectively referred to as "transistors 204B"), having a gate width-to-length ratio of $\alpha_R$, are equivalent to the transistor 204 in FIG. 2A, which has a gate width-to-length ratio of $(1/4)\alpha_R$. Transistors 206-1 and 206-2 (collectively referred to as "transistors 206B"), having a gate width-to-length ratio of $\alpha_R$, are equivalent to the transistor 206 in FIG. 2A, which has a gate width-to-length ratio of $(1/2)\alpha_R$. The output current, $I_O$, of the programmable current mirror 200B may be calculated according to:

$$I_O=(1/n)*I_R,\ 1\leqq n\leqq 8 \qquad \text{Eq. 1}$$

The value of n, which as shown in Equation 1 determines the value of the output current, $I_O$, is determined by the application of a three bit digital control word to open and close switches 212, 214, and 216. Table 1 below illustrates the output current $I_O$ with respect to the reference current $I_R$ for each of the eight three-bit control words.

TABLE 1

| Digital Control Word | n | $I_o$ | $V_{GS}$ of Transistor 202 |
|---|---|---|---|
| 000 | 8 | $1/8(I_R)$ | $V_{GS}=\frac{2I_R}{k\cdot\alpha_R}+V_{th}$ |
| 001 | 7 | $1/7(I_R)$ | $V_{GS}=\frac{2I_R}{k\cdot\alpha_R}+V_{th}$ |
| 010 | 6 | $1/6(I_R)$ | $V_{GS}=\frac{2I_R}{k\cdot\alpha_R}+V_{th}$ |
| 011 | 5 | $1/5(I_R)$ | $V_{GS}=\frac{2I_R}{k\cdot\alpha_R}+V_{th}$ |
| 100 | 4 | $1/4(I_R)$ | $V_{GS}=\frac{2I_R}{k\cdot\alpha_R}+V_{th}$ |
| 101 | 3 | $1/3(I_R)$ | $V_{GS}=\frac{2I_R}{k\cdot\alpha_R}+V_{th}$ |
| 110 | 2 | $1/2(I_R)$ | $V_{GS}=\frac{2I_R}{k\cdot\alpha_R}+V_{th}$ |
| 111 | 1 | $I_R$ | $V_{GS}=\frac{2I_R}{k\cdot\alpha_R}+V_{th}$ |

Table 1 also demonstrates that the gate-to-source voltage, $V_{GS}$, for the reference transistor 202 does not change as the digital control word is changed. Accordingly, the programmable current mirror 200B does not require bias adjustments different control settings, e.g., different control words.

Figure 3B:
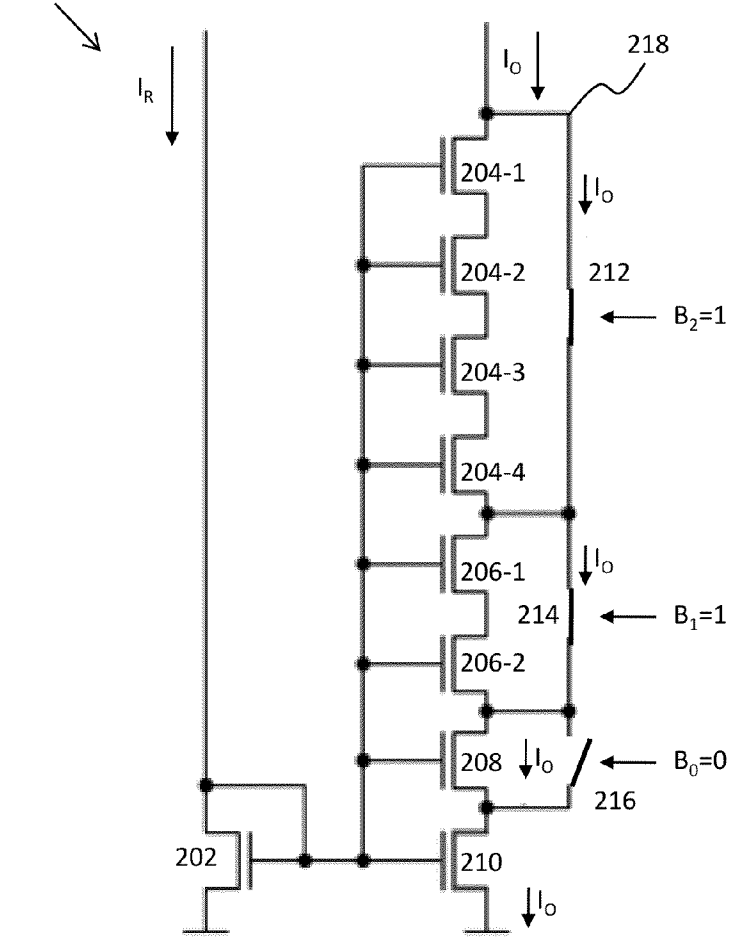
FIGS. 3A-3D illustrate the current mirror illustrated in FIG. 2B receiving various digital control words.
Figure 3A:
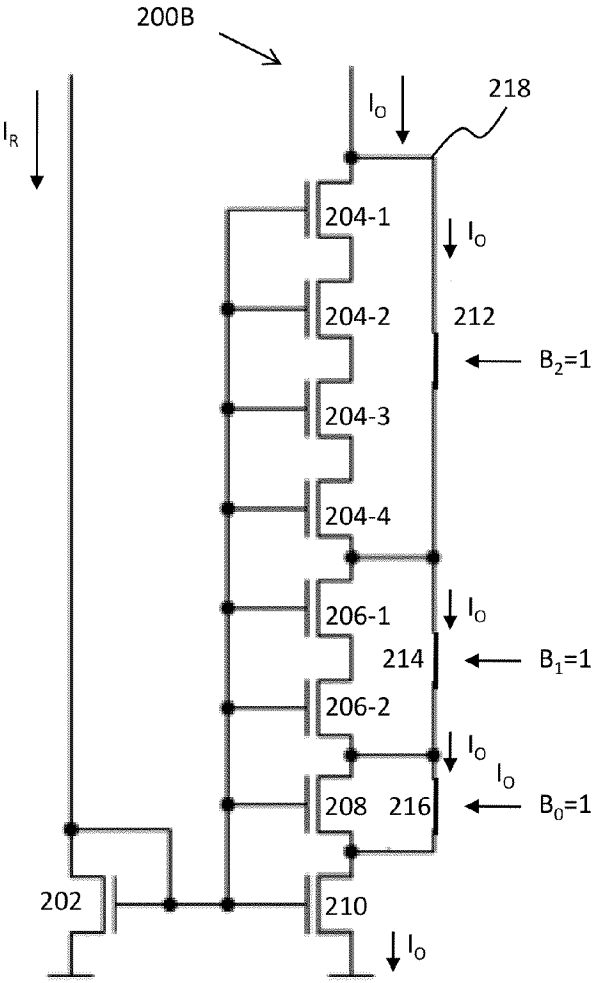

FIGS. 3A-3D illustrate the operation of the programmable current mirror 200B in response to different control words being applied to switches 212, 214, and 216. In FIG. 3A, the digital control word is 111 in which the first or right-most bit, $B_0$, controls the opening and closing of switch 216, the second or middle bit, $B_1$, controls switch 214, and the third or left-most bit, $B_2$, controls switch 212. As shown in FIG. 3A, all of the switches 212, 214, and 216 are closed when the digital control word is 111. With each of the switches 212, 214, and 216 closed, current does not travel through the transistors 204B, 206B, and 208, but instead travels along the current bypass 218 and through transistor 210 as identified by the arrows adjacent to $I_O$. Thus, the output current $I_O$ equals the reference current $I_R$ when the digital control word is 111, and n equals 1 as the gate width-to-length ratio of the mirror transistor 210 is equal to the gate width-to-length ratio of the reference transistor 202.

FIG. 3B illustrates the programmable current mirror 200B when it receives a digital control word of 110. As shown in FIG. 3B, switches 212 and 214 remain closed as the second and third bits, $B_1$ and $B_2$, of the digital control word are logic ones, and the switch 216 is open as the first bit, $B_0$, is a logic zero. The current flow through programmable current mirror 200B is indicated by the arrows adjacent to $I_O$. As shown in FIG. 3B, current bypasses transistors 204B and 206B and passes through transistors 208 and 210 due to switch 216 being open. The magnitude of the output current $I_O$ is half of the reference current $I_R$ since the current passes through transistors 208 and 210 each having a gate width-to-length ratio that is equal to the gate width-to-length ratio of reference transistor 202.

Figure 3D:
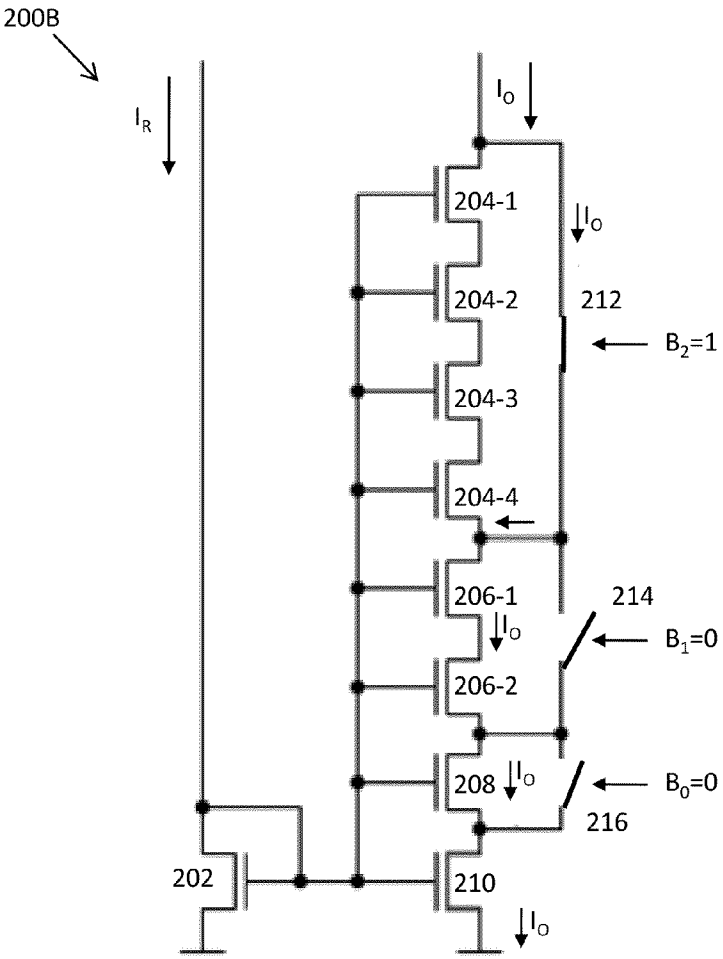
Figure 3C:
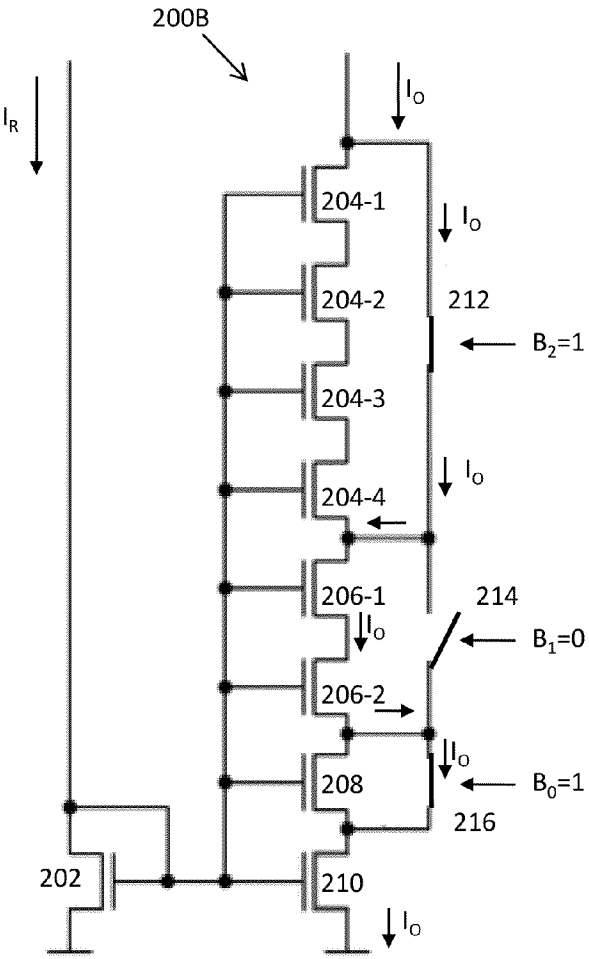

Referring now to FIG. 3C, the programmable current mirror 200B is illustrated as receiving a digital control word of 101. Accordingly, switches 212 and 216 are closed and switch 214 is open as the first and third bits, $B_0$ and $B_2$, of the digital control word are logic ones and the second bit, $B_1$, is a logic zero. With switch 214 open, current does not pass through transistors 204B, but instead passes through switch 212. Current will also pass through transistors 206B due to switch 214 being open in response to receiving a logic zero. Switch 216 is closed in response to receiving a logic one, and thus current does not pass through transistor 208, but instead it passes through switch 216 and then through transistor 210. The magnitude of the output current $I_O$ of the programmable current mirror 200B illustrated in FIG. 3C is one-third of the magnitude of the reference current $I_R$ as the output current $I_O$ passes through three transistors 206-1, 206-2, and 210 each having a gate width-to-length ratio equal to the gate width-to-length ratio of reference transistor 202.

FIG. 3D illustrates the programmable current mirror 200B receiving a digital control word 100. As shown in FIG. 3D, switches 214 and 216 are open as their corresponding bits, $B_0$ and $B_1$, are zeroes, and switch 212 is closed as its corresponding bit, $B_2$, is a one. Accordingly, current bypasses transistors 204B due to switch 216 being closed, passes through transistors 206B and 208 as switches 214 and 216 are open, and then passes through transistor 210. The configuration of programmable current mirror 200B illustrated in FIG. 3D results in the output current $I_O$ having a magnitude of one-fourth the magnitude of the reference current $I_R$ as the output current $I_O$ passes through four transistors 206-1, 206-2, 208, and 210 each having a gate width-to-length ratio equal to the gate width-to-length ratio of reference transistor 202. In this manner, the output current of programmable current mirror 200 may be adjusted depending on the digital control word.

Figure 4:
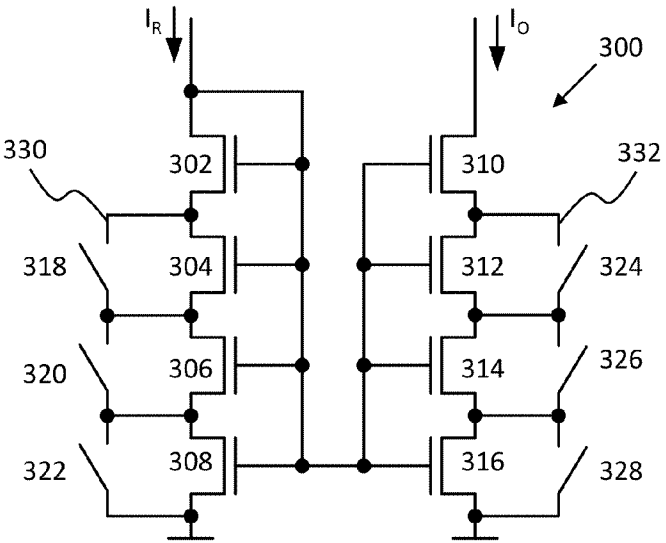
FIG. 4 illustrates another example of an improved rational programmable current mirror.

FIG. 4 illustrates another example of an improved programmable current mirror 300. As shown in FIG. 4, the improved programmable current mirror 300 includes four reference transistors 302, 304, 306, and 308 and four mirror transistors 310, 312, 314, and 316. Transistors 302, 304, 306, and 308 may each have different gate width-to-length ratios as may transistors 310, 312, 314, and 316. A current bypass 330 including switches 318, 320, and 322 is coupled between the sources drains of transistors 302, 304, 306, and 308. More specifically, switch 318 is disposed in parallel with transistor 304, switch 320 is disposed in parallel with transistor 306, and switch 322 is disposed in parallel with transistor 308. Similarly, current bypass 332 includes switches 324, 326, and 328, which are disposed in parallel with transistors 312, 314, and 316. Switch 324 is coupled in parallel with transistor 312, switch 326 is coupled in parallel with transistor 314, and switch 328 is coupled in parallel with transistor 316.

The closing of one or more switches 318, 320, and 322 along current bypass 330 and/or the closing of one or more switches 324, 326, and 328 along bypass 332 adjusts the magnitude of the output current $I_O$ with respect to the reference current $I_R$. For example, with all of the switches 318-328 in the open position, then the output current $I_O$ will be equal to the reference current $I_R$ assuming that the transistors 302 and 310 have the same gate width-to-length ratios, $\alpha_R$. Accordingly, closing one or more of the switches will adjust the gate width-to-length ratio of the reference circuit or the mirror circuit and therefore also change the ratio of the output current $I_O$ with respect to the reference current $I_R$. The opening and closing of the switches 318-328 may be controlled by a six-bit digital control signal with the first or right-most three bits, e.g., bits $B_0$-$B_2$, respectively controlling the opening and closing of switches 328, 326, and 324, and the fourth through sixth bits, e.g., bits $B_3$-$B_5$, respectively controlling the opening and closing of switches 322, 320, and 318.

Figure 5:
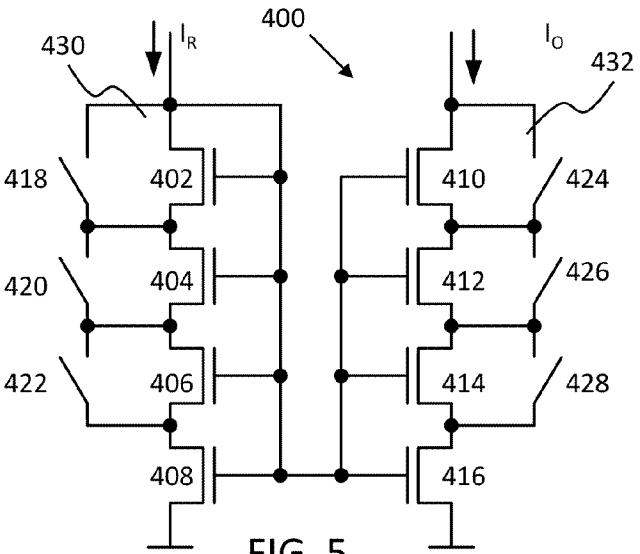
FIG. 5 illustrates another example of an improved rational programmable current mirror.

FIG. 5 illustrates another example of an improved current mirror 400 having a similar design as the current mirror 300 illustrated in FIG. 4. As shown in FIG. 5, the current mirror 400 differs from current mirror 300 in that the current bypasses 430 and 432 are coupled in parallel with transistors 302-306 and 310-314, respectively. Accordingly, the ratio of the output current $I_O$ with respect to the reference current $I_R$ depends on the gate width-to-length ratios of transistors 308 and 316 and may be adjusted by opening and closing switches 418-428.

Figure 6:
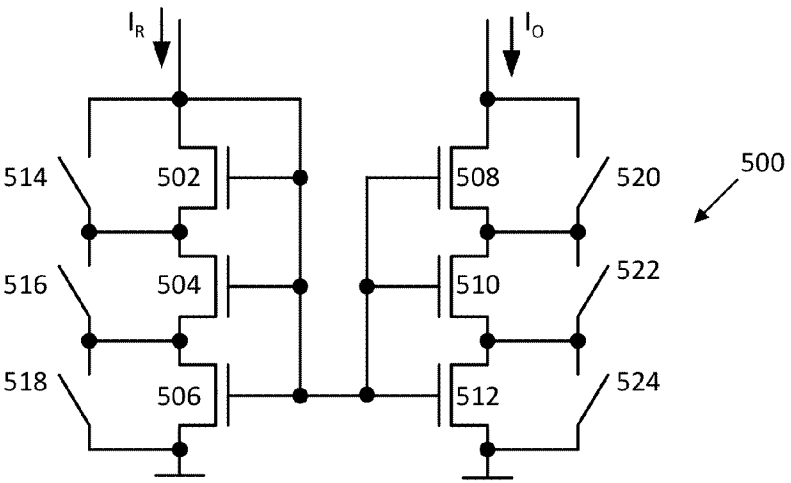
FIG. 6 illustrates another example of an improved rational programmable current mirror.

FIG. 6 illustrates another example of an improved current mirror 500. As shown in FIG. 6, the current mirror 500 includes three reference transistors 502, 504, and 506 having switches 514, 516, and 518 respectively coupled across their sources and drains. Three mirror transistors 508, 510, and 512 are coupled in series with each other and each have a respective switch 520, 522, and 524 coupled to their respective sources and drains such that the switches 520, 522, and 524 are coupled in parallel with the transistors 508, 510, and 512. One skilled in the art will understand that the programmable current mirror 500 may be implemented with fewer or more reference and or mirror transistors than the number of transistors shown in FIG. 6. The ratio of output current $I_O$ to the reference current $I_R$ is controlled by opening and closing switches 514-518 and/or switches 520-524. As described above, the opening and closing of switches 514-524 may be controlled by a six bit digital control word in which the first three bits control the opening and closing of switches 514-518 and the second three bits control the opening and closing of switches 520-524, or vice versa.

Figure 7:
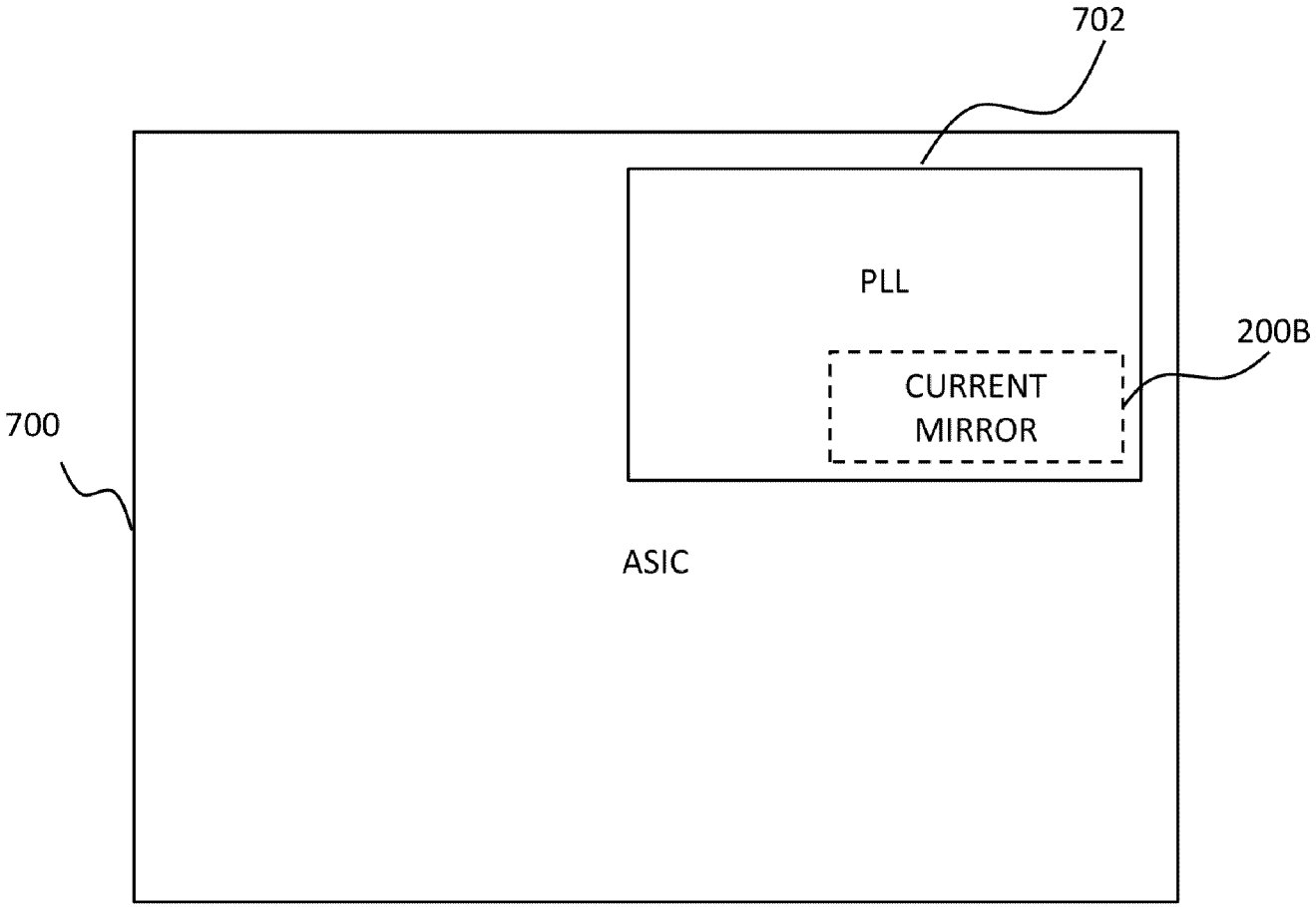
FIG. 7 is a block diagram of one example of a phase-locked loop circuit including an improved programmable current mirror.

The improved programmable current mirror described herein may be incorporated into a phase-locked loop (PLL) circuit for clock generation in a wide range of ASICs including, but not limited to, network controllers, I/O controllers, graphics processors, or the like. FIG. 7 is a block diagram of one example of an ASIC 700 including a PLL circuit 702 in which the improved programmable current mirror 200B is incorporated. Incorporating the improved programmable current mirror 200B into a PLL loop circuit enables the PLL circuit 700 to be implemented in a wide range of ASICs without having to adjust the biasing levels of the programmable current mirror 200B.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A programmable current mirror, comprising:

a reference transistor having a source and a gate directly coupled together at a reference current node;

first and second mirror transistors coupled together in series at a first node, each of the first and second mirror transistors having gates coupled to each other and to the gate of the reference transistor such that the first and second mirror transistors are disposed in parallel with the reference transistor; and a first current bypass including a first switch disposed in parallel with the second mirror transistor, the first current bypass coupled to a source and a drain of the second mirror transistor and to the first node.

2. The programmable current mirror of claim 1, further comprising:

third and fourth mirror transistors coupled in series with the first and second mirror transistors, the third mirror transistor coupled to a second node disposed between the second mirror transistor and the third mirror transistor, each of the third and fourth mirror transistors having gates coupled to the gates of the first and second mirror transistors and to the gate of the reference transistor; and a second current bypass including a second switch disposed in parallel with the third and fourth transistors, the second current bypass coupled to the first current bypass at the second node.

3. The programmable current mirror of claim 2, wherein the opening and closing of the first and second switches is controlled by first and second bits of a digital control word provided to the first and second switches, respectively.

4. The programmable current mirror of claim 3, further comprising:

a plurality of mirror transistors coupled in series with the first, second, third, and fourth mirror transistors, each of the plurality of mirror transistors having a gate coupled to the gates of the first, second, third, and fourth mirror transistors; and a third current bypass coupled in parallel with the plurality of mirror transistors, the third bypass coupled to the second current bypass at a third node, the third node disposed between the fourth mirror transistor and a first one of the plurality of mirror transistors, the third current bypass including a third switch.

5. The programmable current mirror of claim 1, further comprising:

a second reference transistor coupled in series with the first reference transistor at a second node, the second reference transistor having a gate coupled to the gate of the first reference transistor; and a second current bypass including a switch coupled in parallel with the second reference transistor, the second current bypass coupled to a source and a drain of the second reference transistor and to the second node.

6. The programmable current mirror of claim 5, further comprising:

a plurality of mirror transistors coupled in series with the first and second mirror transistors, each of the plurality of mirror transistors having a gate coupled to each of the gates of the plurality of mirror transistors and to the gates of the first and second mirror transistors; and a plurality of current bypasses each including a switch coupled in parallel with a respective one of the plurality of mirror transistors.

7. The programmable current mirror of claim 6, further comprising:

a plurality of reference transistors coupled in series with the first and second reference transistors, each of the plurality of reference transistors having a gate coupled to the gates of the other reference transistors and to the gates of the first and second reference transistors; and a respective current bypass coupled in parallel with each of the plurality of reference transistors, each of the current bypasses including a respective switch.

8. The programmable current mirror of claim 7, wherein the opening and closing of each of the switches is controlled by a respective bit of a digital control word provided to the respective switches.

9. The programmable current mirror of claim 7, wherein each of the reference and mirror transistors has substantially equal gate width-to-length ratios.

10. A programmable current mirror, comprising:

a first reference transistor having a source and a gate coupled directly together at a first node for receiving a reference current;

first, second, third, and fourth mirror transistors coupled in series, the first and second mirror transistors coupled together at a second node, the second and third mirror transistors coupled together at a third node, the third and fourth transistors coupled together at a fourth node, each of the mirror transistors having respective gates coupled to each other and to the gate of the first reference transistor such that the first, second, third, and fourth mirror transistors are disposed in parallel with the reference transistor; and first, second, and third current bypasses, each bypass including a respective switch, the first current bypass coupled to the second and third nodes in parallel with the second mirror transistor, the second current bypass coupled to the third and fourth nodes in parallel with the third mirror transistor, the third current bypass coupled to the fourth node in parallel with the fourth mirror transistor.

11. The programmable current mirror of claim 10, wherein the opening and closing of each of the switches is controlled by a respective bit of a digital control word provided to the respective switches.

12. The programmable current mirror of claim 10, wherein the first reference transistor and the first and second mirror transistors have substantially equal gate width-to-length ratios.

13. The programmable current mirror of claim 12, wherein the third and fourth mirror transistors have gate width-to-length ratios that are fractions having a value of the less than one of the gate width-to-length ratio of the reference transistor.

14. The programmable current mirror of claim 12, wherein a gate width-to-gate of the third mirror transistor is one-half of the gate width-to-length ratio of the reference transistor.

15. The programmable current mirror of claim 12, wherein a gate width-to-length ratio of the fourth mirror transistor is one-quarter of the gate width-to-length ratio of the reference transistor.

16. The programmable current mirror of claim 10, further comprising:

a second reference transistor coupled in series with the first reference transistor at a fifth node, the second reference transistor having a gate coupled to the gate of the first reference transistor and to the gates of the mirror transistors; and a fourth current bypass coupled to the fifth node in parallel with the second reference transistor, the fourth current bypass having a switch.

17. A programmable current mirror, comprising:

a plurality of reference transistors coupled in series, each of the reference transistors having gates coupled together and to a first reference current node;

a plurality of mirror transistors coupled in series with each other, each of the mirror transistors having gates coupled together and to the gates of each of the plurality of reference transistors such that the plurality of mirror transistors are disposed in parallel with the plurality of reference transistors; and a respective current bypass coupled in parallel with each respective one of the reference and mirror transistors, each of the current bypasses including a switch.

18. The programmable current mirror of claim 17, wherein each of the reference transistors and mirror transistors have a substantially equal gate width-to-length ratio.

19. The programmable current mirror of claim 17, wherein the opening and closing of the switches is controlled by respective bits of a digital control word provided to respective ones of the switches.

20. The programmable current mirror of claim 17, wherein the plurality of reference transistors includes a number of transistors that is equal to a number of transistors in the plurality of mirror transistors.

* * * * *